US007609154B2

(12) United States Patent
Bennett

(10) Patent No.: US 7,609,154 B2
(45) Date of Patent: Oct. 27, 2009

(54) TESTING A FIRE DETECTOR SENSOR

(75) Inventor: Steve Bennett, Portsmouth (GB)

(73) Assignee: Thorn Security Limited, Walthamstow, London (GB)

( * ) Notice: Subject to any disclaimer, the term of this patent is extended or adjusted under 35 U.S.C. 154(b) by 383 days.

(21) Appl. No.: 11/587,461

(22) PCT Filed: Apr. 29, 2005

(86) PCT No.: PCT/GB2005/001641

§ 371 (c)(1),
(2), (4) Date: Oct. 25, 2006

(87) PCT Pub. No.: WO2005/106822

PCT Pub. Date: Nov. 10, 2005

(65) Prior Publication Data

US 2007/0216527 A1 Sep. 20, 2007

(30) Foreign Application Priority Data

Apr. 30, 2004 (GB) ..... 0409759-8

(51) Int. Cl.
*G08B 29/00* (2006.01)

(52) U.S. Cl. ..... 340/514

(58) Field of Classification Search ..... 340/514, 340/506, 628, 632, 635; 324/500
See application file for complete search history.

(56) References Cited

U.S. PATENT DOCUMENTS

| | | | | |
|---|---|---|---|---|
| 4,369,435 | A | 1/1983 | Adachi et al. | |
| 5,202,637 | A * | 4/1993 | Jones | 324/425 |
| 6,251,243 | B1 * | 6/2001 | Lindsay | 204/400 |
| 6,314,790 | B1 | 11/2001 | Sagisaka et al. | |
| 6,428,684 | B1 * | 8/2002 | Warburton | 205/775 |
| 2004/0056765 | A1 * | 3/2004 | Anderson et al. | 340/522 |

FOREIGN PATENT DOCUMENTS

| | | |
|---|---|---|
| JP | 59088659 | 5/1984 |
| JP | 03129496 | 6/1991 |

* cited by examiner

*Primary Examiner*—Phung Nguyen

(57) ABSTRACT

A method is disclosed for testing the functionality of a sensor (1) of a fire detector during operation thereof. The method comprises applying a current-limited test signal to the sensor (1), the test signal being such that the impedance of the sensor is such as to absorb the current-limited test signal when the sensor is operating normally; and applying the output of the sensor to a test signal detector (7). The arrangement is such that the test signal passes the output terminal of the sensor (1) only when the sensor is not operating normally.

23 Claims, 2 Drawing Sheets

TESTING A FIRE DETECTOR SENSOR

RELATED APPLICATION

This application claims the benefit of the prior foreign application GB 0409759.8, filed Apr. 30, 2004. The entire teachings of the above application are incorporated herein by reference.

This invention relates to a method of testing a sensor of a fire detector, and to a fire detector which utilises that method. The invention is particularly concerned with the testing of an electro-chemical sensor, but it is also applicable to any fire detector sensor that has a low impedance between its monitored terminals.

There is a range of sensors used within fire detectors for the identification of fires. In some markets, there is a requirement for testing or monitoring each of the sensing components of fire detectors for integrity and correct operation.

It is desired that the operation of each sensor be electrically checked by internal means to confirm that it is functioning correctly. This can be done continuously in real time, or initiated on a regular basis by external control and indicating equipment. One type of sensor used to identify a fire is an electro-chemical cell, an example of this being a carbon monoxide (CO) cell.

A method for checking the integrity of a CO cell in circuit is to apply a voltage across the cell and evaluate its discharge characteristics. With this method, the CO cell is completely ineffective for many minutes (the CO monitoring system must be disabled to prevent a false alarm or a fault indication) until it has been discharged to its nominal operating voltage. Also, additional circuitry is needed to perform this function, and this leads to an increase in size and complexity of the detector, as well as an increase in the required power.

There are self-test systems (internal and external to such a sensor) that contain hydrogen or CO gas reservoirs/generators and gas release mechanisms. However, these are usually intrusive (the CO monitoring system must be disabled to prevent a false alarm), draw a large amount of current, and are subject to environmental influences.

The present invention provides a method for testing the functionality of a sensor of a fire detector during operation thereof, the method comprising the steps of:

a) applying a current-limited test signal to the sensor, the test signal being such that the impedance of the sensor is such as to absorb the current-limited test signal when the sensor is operating normally; and b) applying the output of the sensor to a test signal detector; wherein the arrangement is such that the test signal passes the output terminal of the sensor only when the sensor is not operating normally.

In a preferred embodiment, the test signal is supplied to the sensor by a pulse generator via a current limiter.

The sensor may be located on a detection module and the test signal may be supplied to the detection module.

Advantageously, a remote DC signal is applied to the detection module for determining the year of manufacture of the sensor. Preferably, the test signal and the DC signal are applied to the detection module on the same electrical connection, wherein the DC signal may be monitored to determine whether or not the electrical connection is made.

Preferably, the output of the sensor is applied to the detector via an amplifier.

The method may further comprise applying an offset voltage to the amplifier, so that the output of the amplifier is zero when the sensor is not operating normally.

Preferably, the test signal is such that the capacitance of the sensor is large enough to absorb the current-limited test signal when the sensor is operating normally.

The invention also provides a fire detector comprising a sensor for detecting the presence of a fire, and a test circuit for testing the functionality of the sensor during operation thereof, the test circuit comprising supply means for applying a current-limited test signal to the sensor, and means for applying the output of the sensor to a test signal detector, wherein the supply means is such that the impedance of the sensor is such as to absorb the current-limited test signal when the sensor is operating normally, and the arrangement is such that the test signal passes the output terminal of the sensor only when the sensor is not operating normally.

In a preferred embodiment, a pulse generator provides the test signal, and the test signal is supplied to the sensor via a current limiter.

Preferably, there is provided a detection module which comprises the sensor, a control module separate from the detection module which comprises the pulse generator, and an electrical connecting means to connect the pulse generator to the detection module such that the test signal is supplied to the sensor.

Preferably, the control module comprises a DC voltage supply means arranged to supply the detection module with a DC voltage via the connecting means. Advantageously, the control module comprises means for checking the integrity of the electrical connection by monitoring the DC voltage.

Advantageously, the detection module further comprises a resistive network connected to the electrical connecting means, wherein the resistive value of the resistive network identifies the year of manufacture of the sensor. The control module may comprise a resistive element connected to the DC voltage supply means and a means for measuring the current flowing through the said resistive element, wherein the resistive element may be arranged to form a resistor divider circuit with the resistive network of the detection module such that the means for measuring the current flowing through the resistive element is representative of the year of manufacture of the sensor.

In a preferred embodiment, the current limiter is located on the detection module.

Preferably, an amplifier is provided between the output terminal of the sensor and the detector. Advantageously, the amplifier is constituted by an op-amp and a feedback network.

The fire detector may further comprise means for applying an offset voltage to the amplifier, the arrangement being such that the output of the amplifier is zero when the sensor is not operating normally. Conveniently, a pedestal generator constitutes the means for applying the offset voltage to the amplifier.

Advantageously, a transistor is provided on the output side of the detector and the amplifier, the transistor being effective to short out the output of the amplifier when the test signal passes between the input and output terminals of the sensor.

Preferably, the supply means is such that the capacitance of the sensor is large enough to absorb the current-limited test signal when the sensor is operating normally.

The invention also provides a fire detector system comprising a control module having a means for generating and monitoring a DC signal, and a detection module having a sensor for detecting the presence of a fire, the control module and the detection module being electrically connected, the DC signal being applied to the electrical connection between the control module and the detection module for testing the integrity of the connection, wherein the control module provides a warning signal when the connection is not made.

Preferably, the detection module comprises a resistive network connected to the DC signal, which resistive value determines the year of manufacture of the sensor, and which output is monitored by the control module via the electrical connection.

The invention also provides a control module comprising a pulse generator for applying a test signal to a sensor, a DC supply voltage means, a resistive element connected to the DC supply voltage means, means for measuring the current flowing through the resistive element and means for connecting the DC supply voltage to an external circuit, wherein the means for measuring the current signals an alarm when the DC supply voltage is not connected to an external circuit.

The invention will now be described in greater detail, by way of example, with reference to the accompanying drawings, in which.

Figure 1:
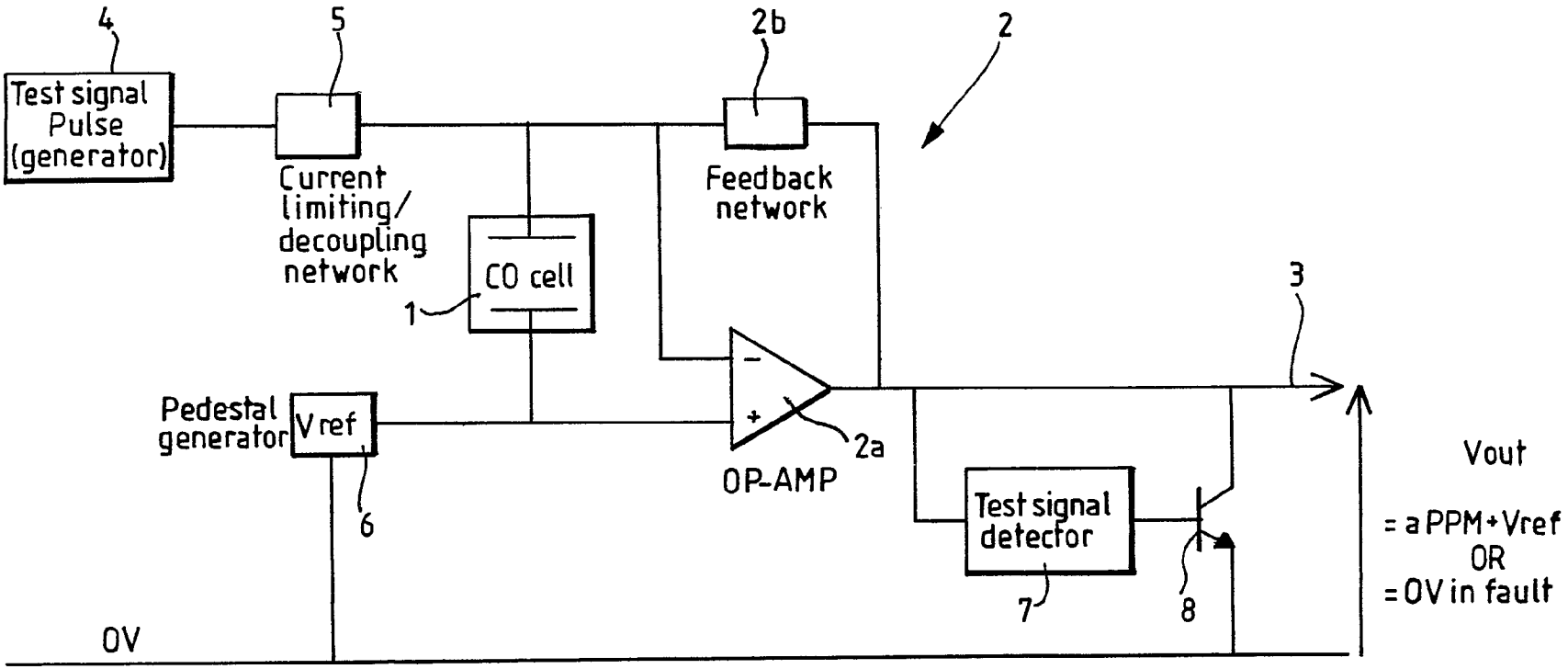
FIG. 1 is a schematic diagram of a fire detector incorporating test means constructed in accordance with a first embodiment of the invention.

Referring to FIG. 1, a fire detector of the first embodiment comprises a CO cell 1, an amplifier circuit 2 constituted by an op-amp 2*a* and a feedback network 2*b*, and an output 3. The op-amp 2*a* is configured for the transimpedance mode, that is to say it converts the small current generated by the CO cell 1 into a larger voltage via the feedback network 2*b*, whilst maintaining zero voltage across the CO cell, thereby acting on the virtual earth principle. In use, the feedback network 2*b* converts the CO cell 1 current into a resultant voltage at the output 3. This network 2*b* is usually a resistor, but it can be adjusted to compensate for noise, EMC, tolerance and temperature characteristics.

The CO cell I is sensitive to minute concentrations of CO—a few parts per million (PPM). As CO is a gas usually produced in the very early stages of a fire, the CO cell 1 is a very effective fire detector sensor.

The drawing also shows elements of the test circuit of the invention, namely a test signal (pulse) generator 4 and a current limiting/decoupling network 5 upstream of the CO cell 1, a pedestal generator 6 feeding the + input of the op-amp 2*a*, and a test signal detector 7 and a transistor 8 at the output of the op-amp. The current limiting/decoupling network 5 reduces the current of the test signal generated by the pulse generator 4 to a level that will not affect the normal operation of the CO cell 1 and the amplifier 2. Owing to the nature of the amplifier 2, the current of the test signal can be very low, certainly much lower than that would affect the CO cell 1. The network 5 can also "decouple" the test signal, such that it will be reduced to a short pulse (as opposed to a continuous current) with the use of a series capacitor. This will further eliminate the possibility of the test signal affecting the CO cell 1 during normal operation.

In use, the pulse generator 4 provides a series of pulses to the CO cell 1, these pulses being current limited by the network 5 to such an extent that the capacitance of the CO cell is great enough to absorb the current limited test signal, so that no resultant voltage will form across the terminals of the CO cell. Under normal circumstances, therefore, the test signal will not be propagated through to the op-amp 2*a*, and so will remain undetected.

The CO cell amplifier circuit 2 must be capable of propagating the test signal if the CO cell 1 has an open circuit fault. Therefore, if the test signal has, for any reason, propagated past the CO cell terminals, been amplified by the op-amp 2*a* and the feedback network 2*b*, and is detected by the test signal detector 7, it will initiate a fault signal to indicate a fault with the CO cell.

The fault can be indicated by the use of a separate signal, or (as shown in the drawing) by modification of the resultant CO amplifier output. For example, the amplifier circuit output can be set to give a 'pedestal' output Vout, set by an offset voltage Vref generated by the pedestal generator 6 under normal conditions, but to give a zero output to indicate a fault. Thus, if the CO cell 1 is removed from the circuit, an internal component within the cell is open circuit, the electrolyte has leaked away, or there is any other catastrophic fault, the capacitance of the cell will not be present, and the test signal will pass through the cell to be amplified by the amplifier circuit 2. Consequently, the test signal will be detected by the test signal detector 7 if the capacitance of the CO cell 1 is not present for any reason. If so, the output of the detector 7 will turn the transistor 8 (which may be a bipolar transistor or a FET) on. This in turn will short out the output of the op-amp 2*a*, hence removing the pedestal from the resultant output voltage Vout.

Vout is a function of the test circuit. If there is no fault in the CO cell 1, Vout will be proportional to the concentration of CO plus the pedestal voltage, that is to say $Vout=Vref+\alpha$, where $\alpha$ is a parameter that is proportional to the CO concentration. If there is a fault in the CO cell 1, Vout=0 volt. For example, if Vref is 1 volt, and the gain of the amplifier gives 0.1 volt per PPM of CO, a Vout of 1 volt means that the CO level is 0 PPM. Similarly, a Vout of 2 volts means that the CO level is 10 PPM. As it is impossible to have a negative PPM of CO, the Vout will only fall below 1 volt (the pedestal voltage) if there is a fault with the CO cell 1. This approach is advantageous if there is a limitation on the number of channels available to report the status of the CO concentration and the test circuit.

Figure 2:
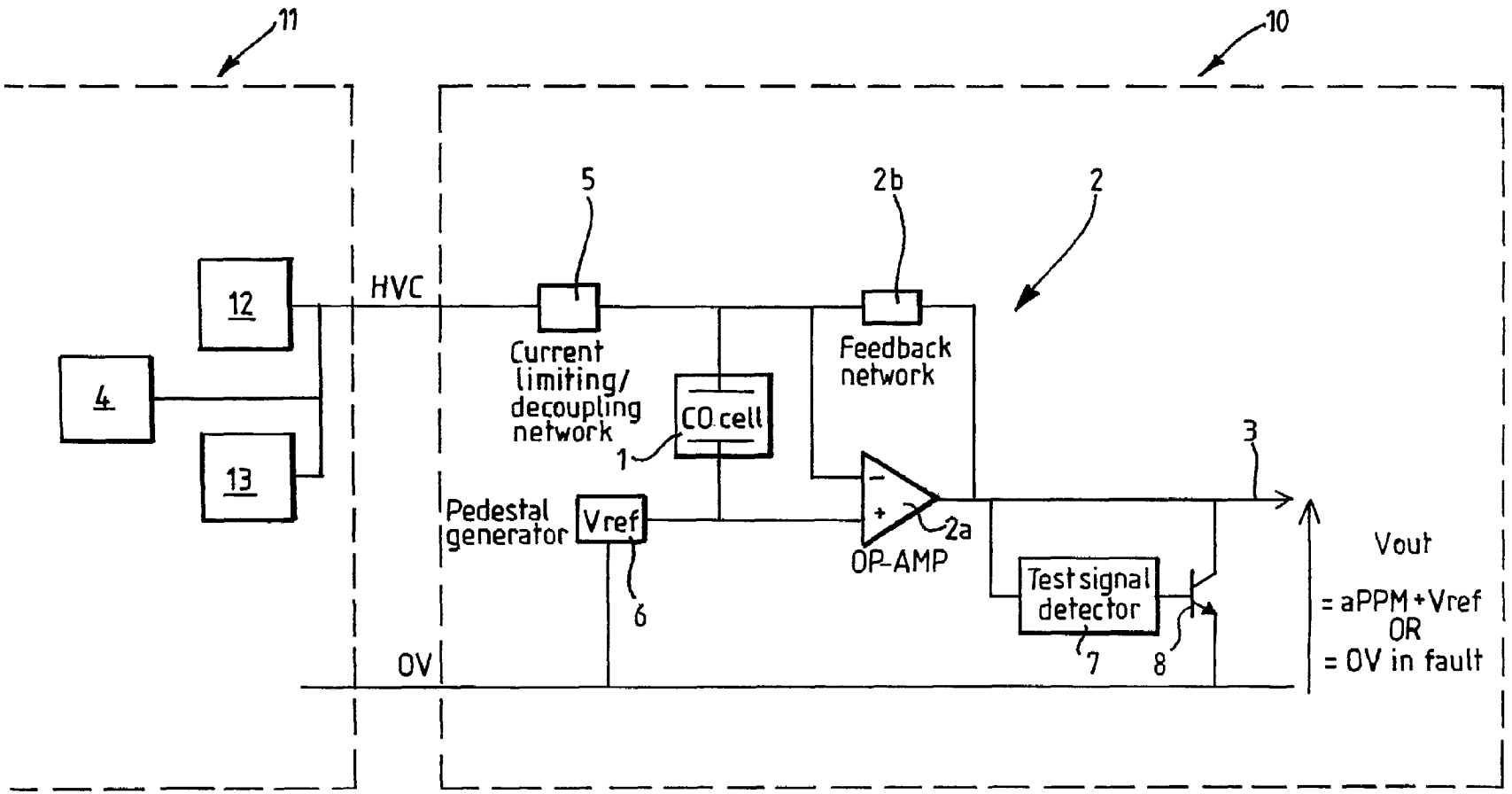
FIG. 2 is a schematic diagram of a fire detector incorporating test means and means for determining the date of manufacture of a sensor constructed in accordance with a second embodiment of the invention.

FIG. 2 shows the second embodiment. The second embodiment is similar to the first, and only the differences will be described. Like reference numerals are used for like parts.

The fire detector of the second embodiment comprises a detection module 10 electrically connected to a control module 11 via two connecting lines HVC and 0V.

The detection module 10 includes the current limiting/decoupling network 5, the pedestal generator 6, the CO cell 1, the amplifier circuit 2, the test signal detector 7 and the transistor 8. The detection module also includes a resistive network 11 connected between the connecting lines HVC and 0V, the resistive network 11 being AC coupled to the current limiting/decoupling network 5 via a capacitor (not shown). The values of the resistors comprising the resistive network 11 are chosen to identify the year of manufacture of the CO cell 1.

The control module 11 includes the test signal pulse generator 4, a DC voltage supply 12 and a current measuring circuit 13. The DC voltage supply 12 is connected to the resistive network 11 via the HVC connecting line and two series resistors (not shown), one of which is located at the output of the control module 11, the other of which is located at the input of the detection module 10. The current monitoring circuit 13 comprises a resistive element (not shown) of a fixed value which, in combination with the resistive network 11, forms a resistor divider network.

In use, the pulse generator 4 provides a series of test pulses to the CO cell 1 via the connecting lines HVC and 0V and the current limiting/decoupling network 5. The CO cell 1 is tested as described in the first embodiment, the only difference being that the pulse generator 4 is located on the control module 11 which is remote from the detection module 10 containing the CO cell 1.

The DC voltage supply 12 generates a DC voltage which, when the control module 11 is connected to the detection module 10 via the HVC connection line, develops across the total resistor divider network including the resistive network 11. The DC voltage is prevented from affecting the operation of the remainder of the detection module 10 because the current limiting/decoupling network 5 is AC coupled to the resistive network 11. The current flowing through the resistor of the current measuring circuit 13 for any given DC supply voltage is therefore determined by the values of the resistors in the resistive network 11, which have been chosen to identify the year of manufacture of the CO cell 1. By measuring the current in this way, the year of manufacture of the CO cell may be determined. In this embodiment, the values of the resistive network 11 are chosen such that the measured current is in proportion to the date of manufacture, for example:

2006=100 mV

2007=200 mV

2008=300 mV

2009=400 mV etc.

The date information is then relayed to control and indication equipment (not shown). This allows a user to identify detection modules 10 where the CO cell 1 has exceeded its guaranteed operating lifetime, thus prompting servicing action.

The integrity of the HVC line can be determined by regularly checking that the DC voltage or current in the control module 11 is not at an unusual level. This test is useful as it indicates whether or not the test pulses are being successfully transmitted to the detection module 10. Without this check, if the HVC line is not connected properly, the test pulses would not be transmitted to the CO cell 1 and no fault condition would be detected if the CO cell were open-circuited or removed.

It will be apparent that the test circuit described above could be modified. For example, the test signal detector 7 could be set to monitor for a voltage level below Vref, or for abnormally fast edges. Moreover, extra circuitry could be added to synchronise the test signal detector 7 to the pedestal generator 6, such that it will inhibit the fault signal to minimise the reporting of a false result.

Although the pedestal generator 6 constitutes an integral part of the test circuit, the configuration of the power supplies for the op-amp 2*a* may require the presence of the pedestal generator even if testing of the CO cell 1 is not required. For example, the Vref output by the pedestal generator 6 could be used to stop the output of the op-amp 2*a* saturating near zero volts. Where the test circuit is incorporated, the fault signal is generated directly from the test signal detector 7.

It is also possible to use other forms of test signal. Thus, the test signal can be derived from any source, for example from the system clock or by using a timing pulse from an unrelated function. Moreover, the test signal generator 4 can be realised by a pull-up or a pull-down configuration, for example by an open collector constant current sink. Furthermore, as indicated above, the fault signal can be indicated by the use of a separate signal which can be fed into, for example, a microprocessor or a transducer.

Finally, although the test circuit described above is used with a CO cell 1, it will be apparent that it could be used for monitoring other electrochemical cells which have a low impedance, or indeed any other fire detector sensor that has a low impedance between its monitor terminals.

It will be apparent that the test circuit described above has a number of advantages. In particular, testing can be carried out while the CO cell 1 is in circuit, so that the cell does not need to be removed or disabled for testing to be carried out. Thus, the CO cell 1 and its associated circuits will continue to operate normally while testing is carried out. Moreover, no long term potential is applied to the CO cell 1, thereby avoiding the cell having a recovery time in which it is not usable.

The main advantage of the test circuit described above is, therefore, that it is able to indicate a fault when there is an error relating to the operation of the CO cell 1. Without the test circuit of the invention, when there is no stimulating gas present in the cell, its nature means that it will not generate or leak any voltage or current. The characteristics of the cell will, therefore, not be any different if there is a fault, or if the cell is not even fitted. The provision of the test circuit thus provides an indication of the integrity of the CO cell 1 within the fire detector circuit.

Another advantage of the test circuit described above is that it is non-intrusive, so it does not require the CO cell monitoring system to be disabled while a test is carried out. The test process will, therefore, not alter the effectiveness of the CO cell 1 (or its associated circuitry) at any time whilst measuring levels of CO concentration. Moreover, the control and indicating equipment associated with the detector can receive real time data regarding the integrity of the CO cell 1.

Another advantage of the test circuit described above is that it will not result in significant degradation of the performance of the CO cell 1 over its lifetime. Consequently, testing can be applied continuously, without problems arising relating to worn out or damaged components. This means that the associated control and indicating equipment can receive continuous feedback about the integrity of the CO cell 1, without affecting its performance.

Another advantage of the test circuit described above is that it does not require the use of a test gas or other stimuli to confirm the operation of the CO cell 1. This means that the test can be applied continuously, without problems arising relating to exhausted components.

The invention claimed is:

1. A method for testing the functionality of a sensor of a fire detector during operation thereof, the method comprising the steps of:

a) applying a current-limited test signal to the sensor, the sensor having an impedance such that sensor absorbs the current-limited test signal when the sensor is operating normally; and b) applying the output of the sensor to a test signal detector via an amplifier circuit;

wherein the arrangement is such that, during testing, the output voltage of the amplifier circuit is substantially constant when the sensor is operating normally, and such that the test signal passes the output terminal of the sensor only when the sensor is not operating normally, whereby the test signal is amplified by the amplifier circuit thereby to provide a signal indicative of a sensor fault.

2. The method as claimed in claim 1, wherein the test signal is supplied to the sensor by a pulse generator via a current limiter.

3. The method as claimed in claim 1, wherein the sensor is located on a detection module and the test signal is supplied to the detection module.

4. The method as claimed in claim 3, further comprising applying a remote DC signal to the detection module for determining the year of manufacture of the sensor.

5. The method as claimed in claim 4, wherein the test signal and the DC signal are applied to the detection module on the same electrical connection, and wherein the DC signal is monitored to determine whether or not the electrical connection is made.

6. The method as claimed in claim 1, further comprising applying an offset voltage to the amplifier circuit, so that the amplifier circuit is zero when the sensor is not operating normally.

7. The method as claimed in claim 1, wherein the test signal is such that capacitance of the sensor is large enough to absorb the current-limited test signal when the sensor is operating normally.

8. The fire detector comprising a sensor for detecting the presence of a fire, and a test circuit for testing the functionality of the sensor during operation thereof, the test circuit comprising supply means for applying a current-limited test signal to the sensor, and means for applying the output of the sensor to a test signal detector, via an amplifier circuit, wherein the sensor has an impedance such that the sensor absorbs the current-limited test signal when the sensor is operating normally, and the arrangement is such that the output voltage of the amplifier circuit is substantially constant when the sensor is operating normally, and such that the test signal passes the output terminal of the sensor only when the sensor is not operating normally, whereby the test signal is amplified by the amplifier circuit thereby to provide a signal indicative of a sensor fault.

9. The fire detector as claimed in claim 8, wherein a pulse generator provides the test signal, and the test signal is supplied to the sensor via a current limiter.

10. The fire detector as claimed in claim 9, wherein there is provided a detection module which comprises the sensor, a control module separate from the detection module which comprises the pulse generator, and an electrical connecting means to connect the pulse generator to the detection module such that the test signal is supplied to the sensor.

11. The fire detector as claimed in claim 10, wherein the control module comprises a DC voltage supply means arranged to supply the detection module with a DC voltage via the connecting means.

12. The fire detector as claimed in claim 11, wherein the control module comprises means for checking the integrity of the electrical connection by monitoring the DC voltage.

13. The fire detector as claimed in claim 11, wherein the detection module further comprises a resistive network connected to the electrical connecting means, and wherein the resistive value of the resistive network identifies the year of manufacture of the sensor.

14. The fire detector as claimed in claim 13, wherein the control module comprises a resistive element connected to the DC voltage supply means and a means for measuring the current flowing through the said resistive element, and wherein the resistive element is arranged to form a resistor divider circuit with the resistive network of the detection module such that the means for measuring the current flowing through the resistive element is representative of the year of manufacture of the sensor.

15. The fire detector as claimed in claim 10, wherein the current limiter is located on the detection module.

16. The fire detector as claimed in claim 8, wherein the amplifier circuit is constituted by an op-amp and a feedback network.

17. A fire detector as claimed in claim 8, further comprising means for applying an offset voltage to the amplifier circuit, the arrangement being such that the output of the amplifier circuit is zero when the sensor is not operating normally.

18. The fire detector as claimed in claim 17, wherein a pedestal generator constitutes the means for applying the offset voltage to the amplifier circuit.

19. The fire detector as claimed in claim 8, wherein a transistor is provided on the output side of the detector and the amplifier circuit, the transistor being effective to short out the output of the amplifier circuit when the test signal passes the output terminal of the sensor.

20. The fire detector as claimed in claim 8, wherein the supply means is such that capacitance of the sensor is large enough to absorb the current-limited test signal when the sensor is operating normally.

21. A fire detector system comprising a control module having a means for generating and monitoring a DC signal, and a detection module having a sensor for detecting the presence of a fire, the control module and the detection module being electrically connected, the DC signal being applied to the electrical connection between the control module and the detection module for testing the integrity of the connection, wherein the control module provides a warning signal when the connection is not made.

22. The fire detection system as claimed in claim 21, wherein the detection module comprises a resistive network connected to the DC signal, which resistive value determines the year of manufacture of the sensor, and which output is monitored by the control module via the electrical connection.

23. A control module comprising a pulse generator for applying a test signal to a sensor, a DC supply voltage means, a resistive element connected to the DC supply voltage means, means for measuring the current flowing through the resistive element and means for connecting the DC supply voltage to an external circuit, wherein the means for measuring the current signals an alarm when the DC supply voltage is not connected to an external circuit.

* * * * *